US010113447B2

(12) United States Patent
Read et al.

(10) Patent No.: US 10,113,447 B2
(45) Date of Patent: Oct. 30, 2018

(54) FAN CASING ARRANGEMENT FOR A GAS TURBINE ENGINE

(71) Applicant: ROLLS-ROYCE PLC, London (GB)

(72) Inventors: Simon Read, Derby (GB); Steven A Radomski, Derby (GB)

(73) Assignee: ROLLS-ROYCE plc, London (GB)

( * ) Notice: Subject to any disclaimer, the term of this patent is extended or adjusted under 35 U.S.C. 154(b) by 431 days.

(21) Appl. No.: 14/941,095

(22) Filed: Nov. 13, 2015

(65) Prior Publication Data

US 2016/0169043 A1 Jun. 16, 2016

(30) Foreign Application Priority Data

Dec. 12, 2014 (GB) ..... 1422134.5

(51) Int. Cl.

| | |
|---|---|
| ***F01D 25/24*** | (2006.01) |
| ***F01D 21/04*** | (2006.01) |
| ***F01D 11/12*** | (2006.01) |
| ***F04D 29/52*** | (2006.01) |

(52) U.S. Cl.

CPC ..... *F01D 25/24* (2013.01); *F01D 11/125* (2013.01); *F01D 11/127* (2013.01); *F01D 21/045* (2013.01); *F04D 29/522* (2013.01); *F05D 2220/32* (2013.01); *F05D 2220/36* (2013.01); *F05D 2230/60* (2013.01); *F05D 2240/55* (2013.01); *F05D 2250/283* (2013.01); *F05D 2260/37* (2013.01); *F05D 2300/43* (2013.01);

(Continued)

(58) Field of Classification Search

CPC ..... F01D 11/12; F01D 11/122; F01D 11/125; F01D 11/127; F01D 25/24; F05D 2220/36

See application file for complete search history.

(56) References Cited

U.S. PATENT DOCUMENTS 5,163,809 A * 11/1992 Akgun ..... F01D 21/045 29/523
5,581,054 A * 12/1996 Anderson ..... B64D 33/02 181/213
6,042,332 A 3/2000 Kochanowski et al.

(Continued)

FOREIGN PATENT DOCUMENTS

| | | | |
|---|---|---|---|
| CH | 151 438 | A | 12/1931 |
| EP | 2865852 | A1 | 4/2015 |
| WO | 2007/035184 | A2 | 3/2007 |

OTHER PUBLICATIONS

Jun. 2, 2015 Search Report issued in British Patent Application No. 1422134.5.

(Continued)

*Primary Examiner* — Richard Edgar
(74) *Attorney, Agent, or Firm* — Oliff PLC

(57) ABSTRACT

There is proposed a fan casing arrangement for a gas turbine engine (10) of a type having a propulsive fan (12), the fan casing arrangement being configured to circumscribe the fan (12) and having a fan case (24) and a fan track liner. The fan track liner is provided around the inside of the fan case (24) so as to adopt a radial position between the fan (12) and the fan case (24), and the arrangement is configured such that the fan track liner includes a liner ring (25) which is radially outwardly biased against the inside of the fan case (24). A related method of installing a fan track liner in a gas turbine engine is also disclosed.

26 Claims, 5 Drawing Sheets

(52) U.S. Cl.
CPC .. *F05D 2300/501* (2013.01); *F05D 2300/603* (2013.01)

(56) References Cited

U.S. PATENT DOCUMENTS

| | | | | |
|---|---|---|---|---|
| 6,368,054 | B1 * | 4/2002 | Lucas | F01D 11/08 415/135 |
| 7,645,120 | B2 * | 1/2010 | Matsumoto | F01D 5/147 29/889.22 |
| 7,771,160 | B2 * | 8/2010 | Shi | F01D 9/04 415/138 |
| 2013/0181436 | A1 | 7/2013 | McPherson et al. | |

OTHER PUBLICATIONS

Apr. 15, 2016 Extended Search Report issued in European Patent Application No. 15194494.9.

* cited by examiner

FAN CASING ARRANGEMENT FOR A GAS TURBINE ENGINE

TECHNICAL FIELD

The present invention relates to fan casing arrangement for a gas turbine engine, and to a method of installing a fan track liner in such an arrangement.

BACKGROUND

In the field of gas turbine engines, and in particular ducted-fan gas turbine engines, it is known to provide fan track liners inside the fan case of the engine, which surrounds the propulsive fan at the front of the engine. Fan track liners typically comprise an abradable liner which is supported by an aluminium honeycomb structure. The abradable liner usually consists of Nomex honeycomb which is filled with a lightweight epoxy filler. This liner forms an aerodynamic seal between the tips of the fan blades and the fan case to minimize leakage of air over the tip of the fan blades. Such leakage needs to be avoided or mitigated because it affects the performance and stability of the fan blades. Under certain operating conditions, it is acceptable for the fan blades to make contact with the abradable liner. The depth of the liner is determined by the orbiting radius of the fan blade assembly following a fan blade failure.

Conventional fan track liners usually have a multipart design which comprises a plurality of separate liner panels which are installed in side-by-side relation around the inner surface of the engine's fan case. A concern with a segmented arrangement is that there can be a number of small gaps between adjacent panels of the liner which can affect the long term integrity of the liner because, for example, they can provide paths for water ingress which can undermine the integrity of the bond formed between the liner and the engine's fan case. Furthermore, circumferential gaps between circumferentially adjacent panels can present steps around the fan track liner which can affect the release trajectory of a fan blade in the event that it becomes detached from the fan.

Conventionally, fan track liner panels are bonded to the engine's fan casing. This has the disadvantage that it makes removal of the panel from the casing difficult. A further problem is that removal of a panel which is securely bonded to the fan casing can cause damage to the fan casing. Whilst a metal fan casing may be able to withstand the forces applied to it during removal of a bonded fan track liner, composite fan casings which are now becoming favoured have much lower tolerance to damage arising during removal of a fan track liner, and which might result in the formation of scratches in the fan casing by chipping away the bonding material used to bond the fan track liner to the fan casing.

SUMMARY

It is therefore an object of the present invention to provide an improved fan casing arrangement for a gas turbine engine. It is another object of the present invention to provide an improved method of installing a fan track liner in a fan casing arrangement for a case turbine engine.

According to a first aspect of the present invention, there is provided a fan casing arrangement for a gas turbine engine of a type having a propulsive fan, the fan casing arrangement being configured to circumscribe the fan and having a fan case and a fan track liner, wherein the fan track liner is provided around the inside of the fan case so as to adopt a radial position between the fan and the fan case, the arrangement being characterised in that the fan track liner includes a liner ring which is radially outwardly biased against the inside of the fan case.

The liner ring may have an axially extending gap (e.g. a discontinuity in a circumferential direction of the ring). The axially extending gap may define two axially extending end faces, e.g. opposing axially extending end faces.

The liner ring may have a leading end and a trailing end (defined with respect to axial air flow through the gas turbine engine), and from the leading end to the trailing end the liner may be free from discontinuities that circumscribe the liner.

The liner ring may comprise only a single discontinuity. The single discontinuity may extend in the axial direction.

The liner ring of the fan track liner may not be adhesively bonded to the fan case.

The liner ring of the fan track liner may be self-supporting.

Optionally, the liner ring is of unitary construction.

The liner ring may be formed from plastics material.

The liner ring may be formed from fibre-reinforced plastic such as, for example, polybutylene.

The liner ring may be resiliently deformable, at least in a radial sense.

The liner ring may be provided in the form of an annulus having a single circumferential gap. The annulus may be cylindrical in form or, more likely for many engine architectures, frustoconical.

Optionally, the liner ring is mechanically fastened to the fan case in the region of said circumferential gap.

The liner ring may be mechanically fastened to the fan case only in the region of said circumferential gap.

According to a second aspect of the present invention, there is provided a gas turbine engine having a fan casing arrangement in accordance with the first aspect.

Optionally, the liner ring of the fan track liner is configured for rotational movement relative to the fan case during operation of the engine.

Alternatively, the liner ring of the fan track liner is configured to remain rotationally static relative to the fan case during operation of the engine.

According to a third aspect of the present invention, there is provided a method of installing a fan track liner in a fan casing arrangement for a case turbine engine of a type having a propulsive fan, the method involving: providing a fan case to circumscribe the fan, providing a flexible liner ring, applying generally radial compression to the liner ring to reduce is radial dimension whilst axially inserting it into the fan case, and subsequently releasing said compression such that said liner ring becomes radially outwardly biased against the inside of the fan case.

Said liner ring may be resiliently deformable in a radial sense, and said step of applying compression involves radially compressing the liner ring against its inherent resilience.

Advantageously, the liner ring is provided in the form of an annulus having a single circumferential gap, and said step of applying compression to the liner ring involves radially overlapping regions of the annulus adjacent said gap.

The method may be such that said step of releasing said compression permits said regions of the annulus to move into a non-overlapping position such that each bears against the inside of the fan case.

Optionally, the method further comprises the step of mechanically fastening the liner ring to the fan case in the region of said gap.

Said step of providing the flexible liner ring may involve forming the liner ring by extrusion.

Alternatively, said step of providing the liner ring involves forming the liner by a moulding process.

DESCRIPTION OF THE DRAWINGS

So that the invention may be more readily understood, and so that further features thereof may be appreciated, embodiments of the invention will now be described by way of example with reference to the accompanying drawings in which.

DETAILED DESCRIPTION

Figure 1:
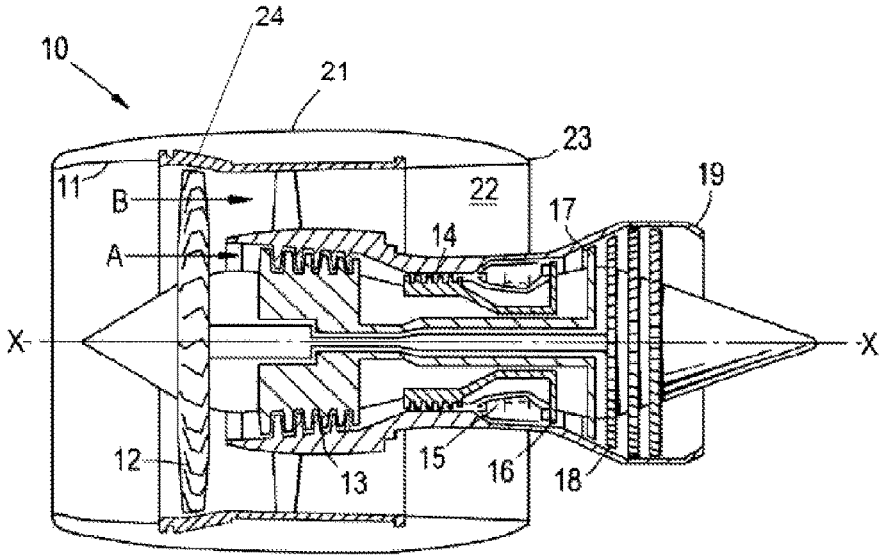
FIG. 1 is a schematic longitudinal cross-sectional view through a gas turbine engine.

Turning now to consider the drawings in more detail, FIG. 1 shows a ducted fan gas turbine, generally indicated at 10, incorporating the invention and which has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Within the forward part of the nacelle 21, there is provided a fan case 24 which extends around the fan 12. As will be described in detail below, the fan case 24 is provided with a fan track liner (not shown in detail FIG. 1) to define a fan casing arrangement in accordance with the present invention and which circumscribes the fan 12.

Figure 2:
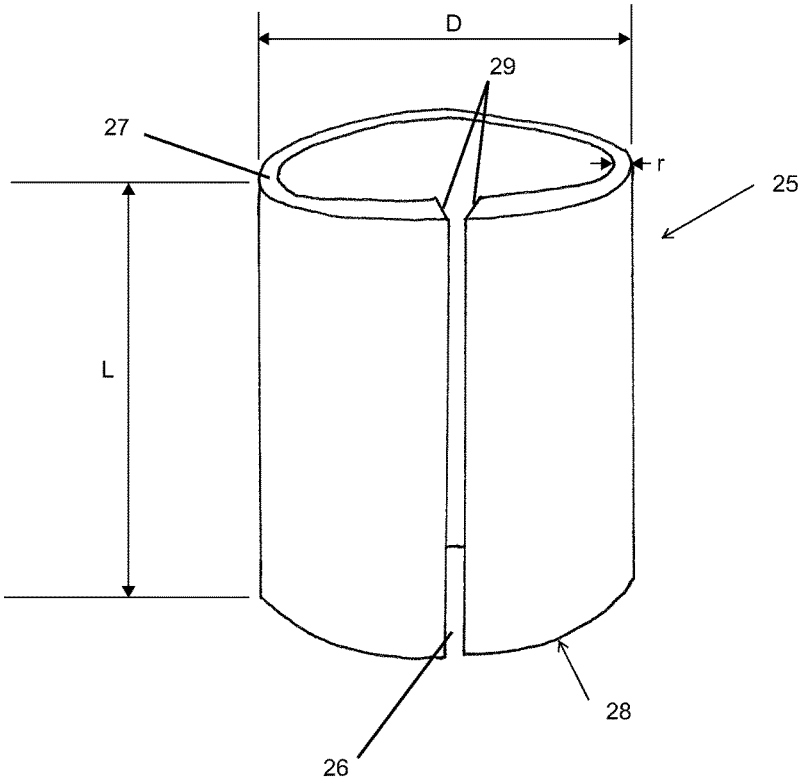
FIG. 2 is a schematic perspective view of a liner ring which may form part of a fan track liner in a fan casing arrangement of the gas turbine engine.

FIG. 2 shows a liner ring 25 of the fan track liner which, as will become apparent hereinafter, forms a principal structural member of the fan track liner. The particular liner ring 25 shown in FIG. 2 takes the general form of a cylindrical annulus, as would be appropriate for installation in a cylindrical region of the fan case 24 (i.e. a region of the fan case 24 in which its innermost surface extends parallel to the rotational axis X-X of the engine). However, as will be appreciated by those skilled in the art, and as indeed as shown in FIG. 1, it is often the case that the fan case 24 of an engine 10, in the region surrounding the fan 12, is somewhat tapered such that it narrows towards the core of the engine which is located downstream of the fan 12. It is therefore to be noted that the liner ring 25 would be configured so as to adopt the general form of a frustoconical annulus for installation in such an engine 10. The cylindrical form of the liner element 25 is shown in the drawings for the sake of convenience and simplicity.

The liner element 25 is of unitary construction and is formed from a resiliently deformable material. It is envisaged that the liner element may be formed from plastics material, such as polybutylene, and may be fibre-reinforced. The liner ring 25 may thus be formed by an injection moulding process, or alternatively by extrusion.

The liner element 25 is illustrated in FIG. 2 in a relaxed condition in which it has an external diameter D which is somewhat larger than internal diameter of the fan case 24 in the region in which it extends around the fan 12. The liner ring 25 is also configured so to have a constant radial wall thickness r across its entire extent, and an axial length L.

As will be noted, the liner element 25 is formed so as to have a single linear gap or slot 26 formed through the entire wall thickness r of the ring, the gap 26 extending generally parallel to the longitudinal axis X-X and along the entire length L of the ring, from one end surface 27 of the ring to the opposite end surface 28 of the ring.

The gap 26 thus defines a pair of oppositely directed wall surfaces 29 which are arranged in facing relationship across the gap 26. In some embodiments it is envisaged that the wall surfaces 29 may extend radially. However in the embodiment illustrated it will be noted that the wall surfaces 29 both make an acute angle to the radial direction such that the circumferential thickness of the gap 26 is tapered across the wall thickness r of the liner ring 25, thus making the gap 26 narrower at the external surface of the ring than at the inner surface of the ring, as illustrated most clearly in FIG. 3. Both wall surfaces 29 may be planar.

Figure 4:
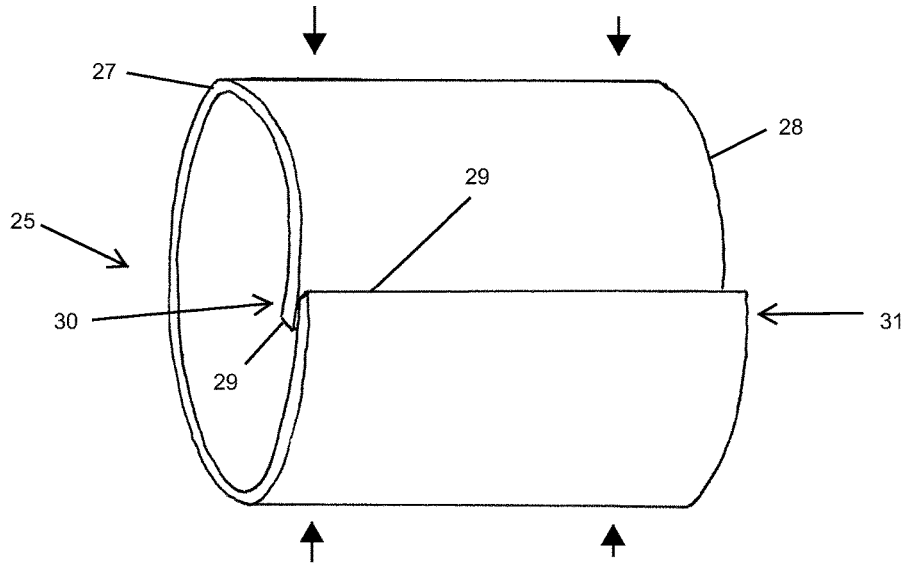
FIG. 4 shows the liner ring, in perspective view, in a generally radially compressed condition.

FIG. 4 shows the liner ring 25 in a generally radially compressed condition in which it has been compressed in a radial sense against its inherent resilience, as illustrated schematically by arrows. As will be noted, in this radially compressed condition the gap 26 has been completely closed up and the regions 30, 31 of the ring to either side of the gap 26 have also been manipulated such that they have become overlapped, with one region 30 adopting a position in which it is located radially inwardly of the other region 31. As will be appreciated, in this condition the liner ring 25 has an external diameter which is less than its relaxed diameter D.

Figure 5:
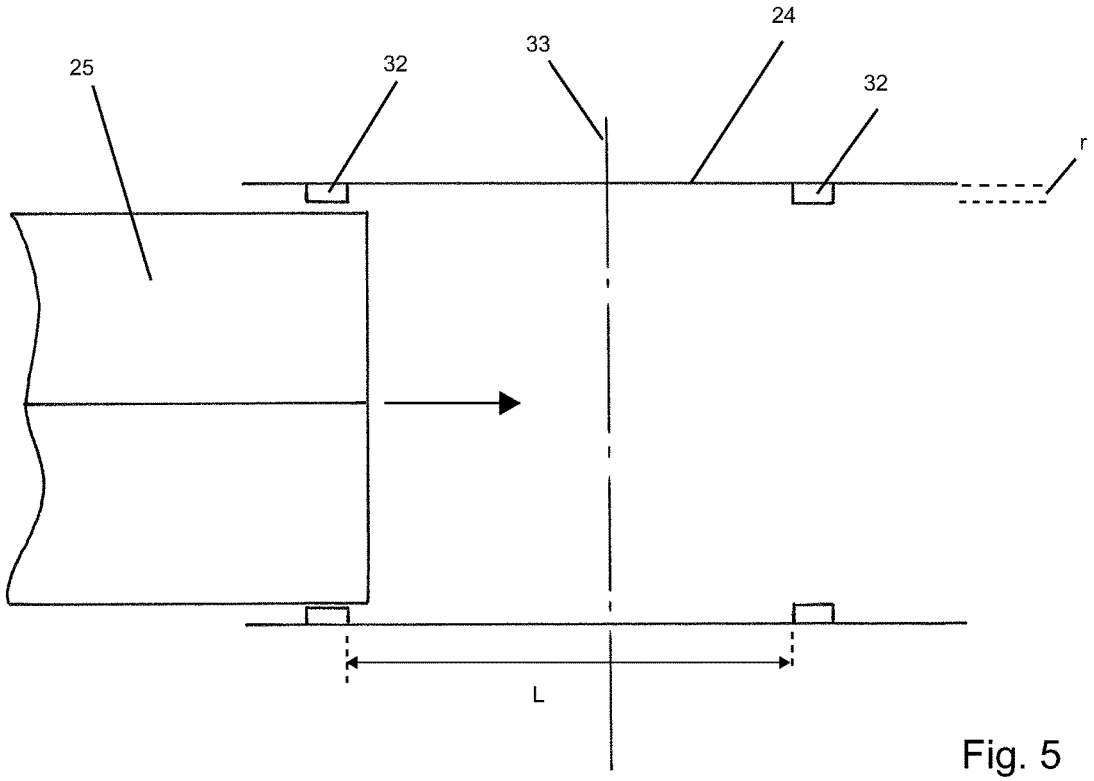
FIG. 5 is a schematic longitudinal cross-sectional view through part of the engine's fan case, showing a method step in which the liner ring is inserted into the fan case.

Turning now to consider FIG. 5, the radially compressed liner ring 25 is shown being moved axially into the engine's fan case 24. In the arrangement illustrated, the fan case is provided with a pair of circumferentially extending locating ribs 32 which project radially inwardly from the fan case wall and which are axially spaced apart from one another on opposite sides of the plane 33 in which the engine's fan 12 rotates. It is proposed that the ribs 32 may either be formed integrally as part of the fan case 24, or may be attached to the fan case 24. The ribs 32 may project radially inwardly from the fan case wall by a distance equal to the radial thickness r of the liner ring 25, and are axially spaced apart from one another by a distance equal to the longitudinal length L of the liner ring 25.

As illustrated in FIG. 5, the liner ring 25 is installed inside the fan case 24 by moving it axially into the fan case 24 whilst in its radially compressed condition. In this condition the liner ring 25 can be moved axially past the first locating rib 32 until it becomes axially located between the two ribs 32, whereupon the radial compression can be released such that the liner ring then expands radially under its inherent resilience, thereby causing its overlapped regions 30, 31 to move into non-overlapping positions in which they each bear against the inside of the fan case 24, and such that the liner ring 25 as a whole adopts the position illustrated in FIG. 6 in which its outer surface bears against the inner surface of the fan case 24, and it is located axially between the two locating ribs 32.

Figure 3:
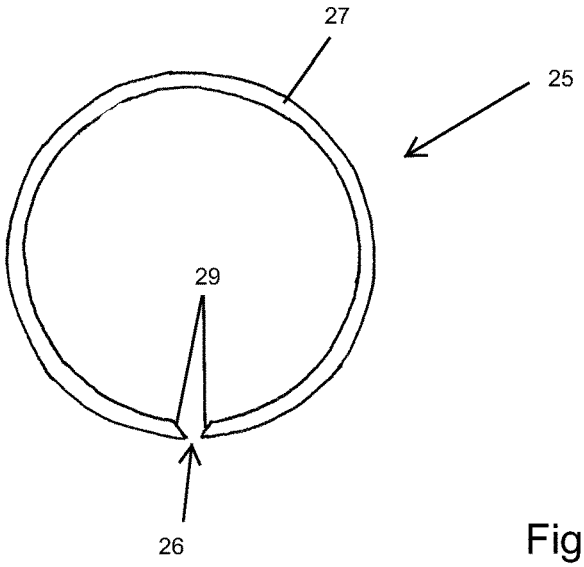
FIG. 3 is an axial view of the liner ring shown in FIG. 3.
Figure 6:
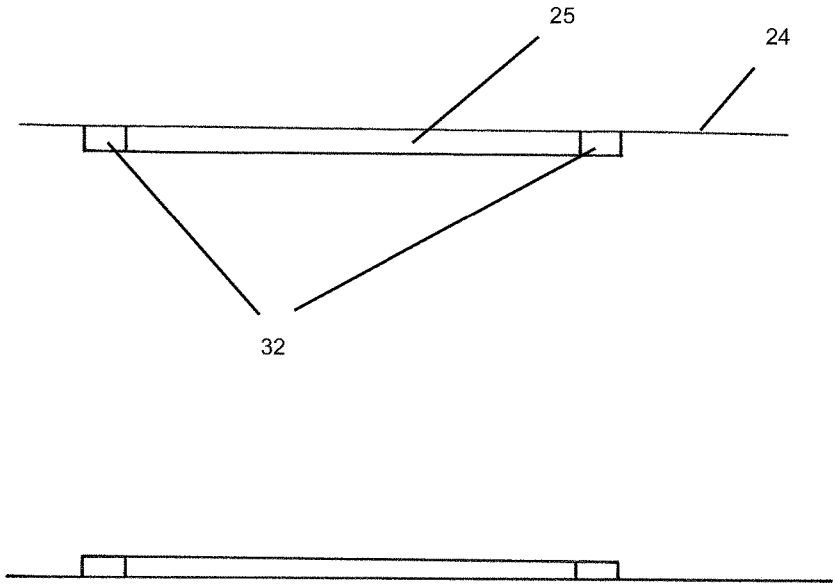
FIG. 6 is a schematic illustration corresponding generally to that of FIG. 5, but which shows the liner ring in position inside the fan case.

It is to be appreciated, that when the radial compression is released from the liner ring 25 such that it adopts the position illustrated in FIG. 6, the liner ring 25 returns towards its relaxed condition illustrated in FIGS. 2 and 3. However, because the relaxed outer diameter D of the liner ring is larger than the internal diameter of the fan case 24, the liner ring is not able to achieve its fully relaxed condition and so bears against the fan case with a degree of outward bias arising from its inherent resilience. This means that the liner ring 25 exerts a radially outward force against the fan case 24, and as such is circumferentially preloaded against the fan case 24. The liner ring 25 is thus self-supporting in the sense that it retains its installed position within the fan case 24 as illustrated in FIG. 6 without any mechanical connection to the fan case 24. Furthermore, it will be noted that when the liner ring 25 is installed in the fan case 24 in this manner it will present no axial discontinuities or circumferentially extending gaps in the region of the engine's fan 12, and only a single circumferential discontinuity, at the axially extending gap 26 which can be filled with appropriate filler material.

The above-mentioned circumferential preload is preferably high enough to provide sufficient friction between the outer surface of the liner ring 25 and the inner surface of the fan case 24 to prevent the liner ring 25 from rotating relative to the fan case 24 during operation of the engine 10, and in particular as the blades of the fan 12 rub against the fan track liner comprising the liner ring 25, or in the event that a fan blade becomes detached from the fan and impacts with the fan track liner. Accordingly, it is unnecessary to adhesively bond the liner ring 25 to the fan case 24. Nevertheless, in some embodiments it is proposed to mechanically fasten the liner ring 25 to the fan case 24, as will be described below.

Figure 7:
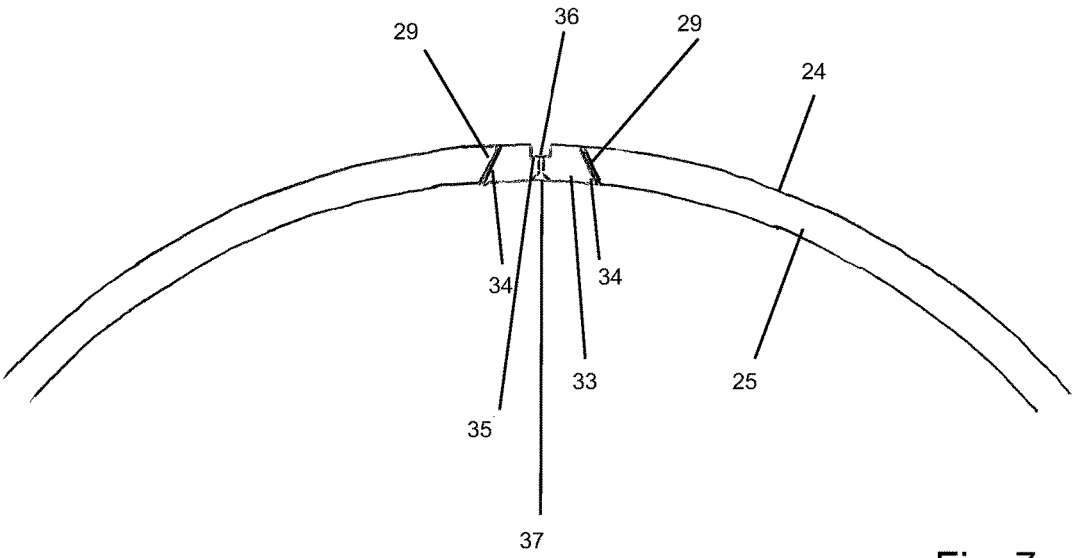
FIG. 7 is a schematic radial cross-sectional view showing a region of the liner ring, and in particular how it may be fastened to the fan case.

FIG. 7 is a transverse cross-sectional view showing a circumferential region of the liner ring 25 installed against the fan case 24, and which shows in particular the gap 26 in the liner ring 25. The liner ring 25 is shown mechanically fastened to the fan case 24 in the region of the gap 26, via the use of a wedge element 33 which is used to fill the gap 26 along the entire axial length L of the liner ring 25. The wedge element is tapered in the radial sense so as to define opposing sloped wedge surfaces 34 which are configured to bear against and make intimate contact with respective wall surfaces 20 of the liner ring.

As illustrated in FIG. 7, the wedge element 33 has an axial channel 35 which is sized and configured to engage an axially extending fixing rib 36 which projects radially inwardly from the fan case 24. The wedge element 33 is inserted into the gap 26 in the liner ring 25 and bolted to the fixing rib 36 by radially extending countersunk bolts 37 as shown, which ensures that as the bolts 37 are drawn up tight the wedge surfaces 34 are urged into contact with the wall surfaces 29 of the liner ring 25, to thereby urge the wall surfaces 34 circumferentially apart from one another, thereby increasing the radially outward force applied to the fan case 24 by the liner ring 25. The wedge element 33 may be bolted to the fixing rib 36 at axially spaced apart positions along the length of the gap 26, but in preferred embodiments it is proposed that it will only be bolted to the fixing rib 36 at its axially front and rear ends so to ensure that there are no fixing bolts 37 in the region of the travel of the fan's blades.

It is envisaged that in some embodiments the liner ring 25, when installed in the fan case as described above, could then have its radially inwardly directed surface covered by a tessellated array of attrition tiles (not shown). In such an arrangement then it is envisaged that the attrition tiles, which could for example be made from Nomex or similar material, could be adhesively bonded to the liner ring 25 and any inter-tile gaps filled with suitable filler material. However it will be noted that even in this sort of arrangement, no adhesive bond would be formed between the liner ring 25 itself and the fan case 24, which means that removal of the liner ring 25, for example as a result of damage requiring replacement or during routine service, would be achievable very simply and without the risk of causing damage to the fan case 24 by breaking apart adhesive bonds.

Figure 8:
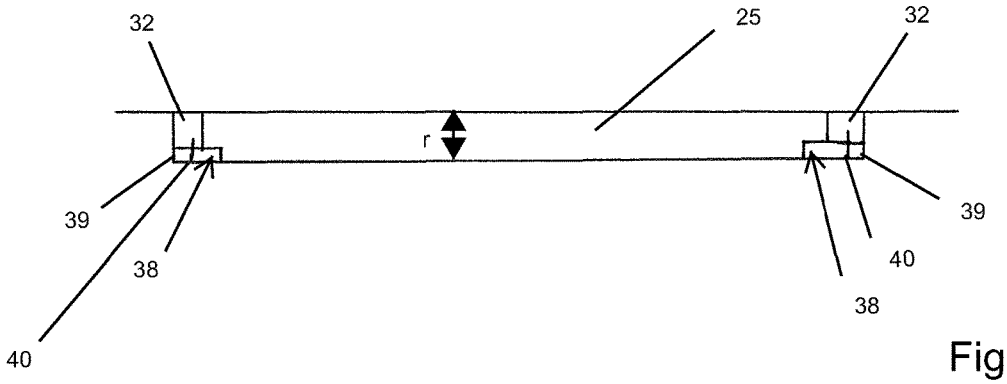
FIG. 8 is a schematic longitudinal cross-sectional drawing showing an alternative, or additional, way of fasting the liner ring to the fan case.

FIG. 8 illustrates another manner of mechanically fixing the liner ring 25 to the fan case 24, which could either be used instead of, or in addition to, the wedge-type fixture described above and illustrated in FIG. 7. In the arrangement of FIG. 8 the liner ring has a radial thickness r which is slightly greater than the distance by which the locating ribs 32. However at its axially front end rear ends the liner ring 25 is stepped, as shown at 38 in FIG. 8. A retention plate 39 is fixed to each locating rib 32, for example by radially extending pins or bolts 40 as shown, and which engages within a respective step 38 in the liner ring to retain it radially against the fan case 24. In this regard it is to be noted that the retention plates 39 may extend only across a relatively short circumferential extent of the liner ring (for example in the region of the wedge element 33 if used in conjunction therewith), or may alternatively extend around the full circumference of the liner ring 25.

Whilst the present invention has been described above with reference to specific embodiments in which the liner ring 25 is mechanically fastened to the fan case 24 such that it will remain rotationally static relative to the fan case 24 during normal operation of the engine and in the event that one or more fan blades should become detached from the fan 12 during engine operation, in other embodiments it may be advantageous to configure the arrangement such that the liner ring 25 is permitted to rotate relative to the fan case 24. This might, for example, be particularly advantageous in the event of a fan blade detaching from the engine's fan 12 and becoming embedded in the liner ring 25, as rotational movement of the liner ring 25 relative to the fan case could provide a useful energy absorbing function. It is therefore envisaged that the above-described types of mechanical fixture between the liner ring 25 and the fan case 24 could be configured to release and permit such relative movement in such circumstances.

As will be appreciated, the above-described arrangements incorporating the liner ring 25 offer several advantages over prior art fan casing arrangements. Firstly, the simple unitary construction of the liner ring 25 which is used to form the fan track liner is much simpler to fabricate than more complex prior art arrangements, to the degree that it can be moulded or extruded. Secondly, the actual method by which the liner ring 25 is installed in the fan case is considerably simpler than with fan track liners. Thirdly, the liner ring arrangement of the present invention means that the principle component of the fan track liner does not need to be adhesively bonded to the fan case 24, which makes both its installation and subsequent removal easier. Furthermore, the unitary construction of the liner ring 25 considerably reduces the number of circumferential discontinuities in the fan track liner.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A fan casing arrangement for a gas turbine engine of a type having a propulsive fan, the fan casing arrangement being configured to circumscribe the fan, the fan casing comprising:

a fan case;

a fan track liner provided around the inside of the fan case so as to adopt a radial position between the fan and the fan case, the fan track liner including a liner ring having two opposing axially extending end faces spaced apart and forming a gap there between, the two opposing axially extending end faces being angled to each make an acute angle to a radial direction such that a circumferential thickness of the gap is narrower at an external surface than an internal surface of the liner ring; and a wedge shaped member extending axially within the gap, the wedge shaped member including a radial taper with sloped wedge surfaces corresponding to and in contact with the two opposing axially extending end faces, wherein the liner ring is radially outwardly biased against the inside of the fan case.

2. The fan casing arrangement according to claim 1, wherein the liner ring of the fan track liner is not adhesively bonded to the fan case.

3. The fan casing arrangement according to claim 1, wherein the liner ring of the fan track liner is self-supporting.

4. The fan casing arrangement according to claim 1, wherein the liner ring is of unitary construction.

5. The fan casing arrangement according to claim 1, wherein the liner ring is formed from plastics material.

6. The fan casing arrangement according to claim 1, wherein the liner ring is formed from fibre-reinforced plastic.

7. The fan casing arrangement according to claim 1, wherein the liner ring is formed from polybutylene.

8. The fan casing arrangement according to claim 1, wherein the liner ring is resiliently deformable, at least in a radial sense.

9. The fan casing arrangement according to claim 1, wherein the liner ring provided in the form of an annulus having a single gap that extends in an axial direction and defines the two axially extending end faces.

10. The fan casing arrangement according to claim 9, wherein the liner ring is mechanically fastened to the fan case at the axially extending gap.

11. The fan casing arrangement according to claim 10, wherein the liner ring is mechanically fastened to the fan case only at the axially extending gap.

12. The fan casing arrangement according to claim 11, wherein the liner ring is mechanically fastened to the fan case via the wedge shaped member that is configured to abut against both of the two axially extending end faces of the liner ring.

13. A gas turbine engine having a fan casing arrangement according to claim 1.

14. The gas turbine engine according to claim 13, wherein the wedge shaped member is configured to allow rotational movement of the liner ring relative to the fan case during operation of the engine.

15. The gas turbine engine according to claim 13, wherein the liner ring of the fan track liner is configured to remain rotationally static relative to the fan case during operation of the engine.

16. The fan casing arrangement according to claim 1, wherein the fan case includes an axially extending rib extending radially inward from the liner ring and the wedge shaped member includes an axially extending channel extending radially inward from an outer surface of the wedge shaped member, and the axially extending rib is located within the axially extending channel.

17. The fan casing arrangement according to claim 16, further comprising fasteners extending through the wedge shaped member and into the axially extending rib to secure the wedge shaped member and the liner ring to the fan case.

18. A method of installing a fan track liner in a fan casing arrangement for a case turbine engine of a type having a propulsive fan, the method comprising:

providing a fan case to circumscribe the fan, providing a liner ring, the liner ring having two opposing axially extending end faces spaced apart and forming a gap there between, the two opposing axially extending end faces being angled to each make an acute angle to a radial direction such that a circumferential thickness of the gap is narrower at an external surface than an internal surface of the liner ring;

applying generally radial compression to the liner ring to reduce a radial dimension of the liner ring whilst axially inserting the liner ring into the fan case;

subsequently releasing said compression such that said liner ring becomes radially outwardly biased against the inside of the fan case; and inserting a wedge shaped member including a radial taper with sloped wedge surfaces corresponding to the two opposing axially extending end faces into the gap, such that the wedge shaped member extends axially within the gap and the sloped wedge surfaces are in contact with the two opposing axially extending end faces.

19. The method according to claim 18, wherein said liner ring is resiliently deformable in a radial sense, and said step of applying compression involves radially compressing the liner ring against its inherent resilience.

20. The method according to claim 18, wherein the liner ring is provided in the form of an annulus having a single axially extending gap, and said step of applying compression to the liner ring involves radially overlapping regions of the annulus adjacent said gap.

21. The method according to claim 20, wherein said step of releasing said compression permits said regions of the annulus to move into a non-overlapping position such that each bears against the inside of the fan case.

22. The method according to claim 21, further comprising the step of mechanically fastening the liner ring to the fan case at the gap.

23. The method according to claim 18, wherein the fan case includes an axially extending rib extending radially inward from the liner ring and the wedge shaped member includes an axially extending channel extending radially inward from an outer surface of the wedge shaped member, and inserting the wedge shaped member into the gap includes locating the axially extending rib within the axially extending channel.

24. The method according to claim 23, further comprising securing the wedge shaped member and the liner ring to the fan case with fasteners that extend through the wedge shaped member and into the axially extending rib.

25. A fan casing arrangement for a gas turbine engine of a type having a propulsive fan, the fan casing arrangement being configured to circumscribe the fan, the fan casing comprising:

a fan case;

a fan track liner provided around the inside of the fan case so as to adopt a radial position between the fan and the fan case, the fan track liner including a liner ring having two opposing axially extending end faces spaced apart and forming a gap there between; and a wedge shaped member extending axially within the gap, the wedge shaped member including wedge surfaces corresponding to and abutting the two opposing axially extending end faces, wherein the liner ring is radially outwardly biased against the inside of the fan case, and the liner ring is mechanically fastened to the fan case via the wedge shaped member.

26. A method of installing a fan track liner in a fan casing arrangement for a case turbine engine of a type having a propulsive fan, the method comprising:

providing a fan case to circumscribe the fan, providing a liner ring, the liner ring having two opposing axially extending end faces spaced apart and forming a gap there between;

applying generally radial compression to the liner ring to reduce a radial dimension of the liner ring whilst axially inserting the liner ring into the fan case;

subsequently releasing said compression such that said liner ring becomes radially outwardly biased against the inside of the fan case; and inserting a wedge shaped member including wedge surfaces corresponding to and abutting the two opposing axially extending end faces into the gap, such that the wedge shaped member extends axially within the gap and the wedge surfaces are in contact with the two opposing axially extending end faces; and mechanically fastening the liner ring to the fan case via the wedge shaped member.

* * * * *